US005672095A

United States Patent [19]

Morimoto et al.

[11] Patent Number: 5,672,095

[45] Date of Patent: Sep. 30, 1997

[54] ELIMINATION OF PAD CONDITIONING IN A CHEMICAL MECHANICAL POLISHING PROCESS

[75] Inventors: Seiichi Morimoto, Beaverton; Ebrahim Andideh, Portland, both of Oreg.

[73] Assignee: Intel Corporation, Santa Clara, Calif.

[21] Appl. No.: 536,570

[22] Filed: Sep. 29, 1995

[51] Int. Cl.[6] ..... B24B 1/00

[52] U.S. Cl. ..... 451/41; 451/285; 451/287; 451/288

[58] Field of Search ..... 451/41, 285, 287, 451/288, 289

[56] References Cited

U.S. PATENT DOCUMENTS 4,910,155 3/1990 Cote et al. .

5,245,796 9/1993 Miller et al. .

5,264,010 11/1993 Brancaleoni .

*Primary Examiner*—Eileen P. Morgan

*Attorney, Agent, or Firm*—Blakely, Sokoloff, Taylor & Zafman

[57] ABSTRACT

A method and apparatus for polishing a film formed over a semiconductor substrate. The substrate is pressed up against an abrasive pad so that the film contacts the pad. The pad has a diameter which is less than approximately two times a diameter of the substrate. While pressure is applied to the back of the substrate, the pad is rotated with respect to the wafer and an abrasive ceria slurry is introduced onto the pad to polish the film.

26 Claims, 2 Drawing Sheets

ELIMINATION OF PAD CONDITIONING IN A CHEMICAL MECHANICAL POLISHING PROCESS

FIELD OF THE INVENTION

The present invention relates to semiconductor processing and more particularly to a chemical mechanical polishing process for polishing a film on a semiconductor substrate.

BACKGROUND OF THE INVENTION

Integrated circuit (IC) devices manufactured today generally rely on transistors, resistors, and other IC components formed on a semiconductor substrate which are wired together by an elaborate system of conductive interconnects. The technology for forming these components and interconnects is highly sophisticated and well understood by practitioners skilled in the art. In a typical IC device manufacturing process, many layers of interconnects are formed over the components on a semiconductor substrate, each layer being electrically insulated from adjacent layers by an interposing dielectric layer. It is extremely important that the surface of these interposing dielectric layers be as flat, or planar, as possible to avoid problems associated with optical imaging and step coverage which could frustrate the proper formation and performance of the IC device.

As a result, many planarization technologies have evolved to support the IC device manufacturing industry. One such technology is called chemical mechanical polishing or planarization (CMP). CMP includes the use of lapping machines and other chemical mechanical planarization processes to smooth and etch away the surface of a layer, such as a dielectric layer, to form a thinned, planar surface. This is achieved by rubbing the surface with an abrasive material, such as a polishing pad in conjunction with an abrasive slurry, to physically etch away the surface, much in the same way sandpaper smoothes the surface of wood. Rubbing of the surface may be performed in the presence of certain chemicals which may be capable of chemically etching the surface as well. After a dielectric layer has been sufficiently smoothed using CMP, interconnects and other components can be accurately and reliably formed on the resulting planar surface.

FIG. 1 shows a chemical mechanical polisher used for CMP of semiconductor substrates. The polisher comprises a semiconductor substrate carrier 11 to which a semiconductor substrate 12 is affixed. A polishing surface comprising a polishing pad 13 is attached to the top of table 10. A nozzle 14 is used to transport a polishing agent called a slurry to pad 13. A conditioner 15 comprises sharp protrusions which are dragged across the surface of pad 13 to roughen and condition the pad.

Semiconductor substrate 12 is mounted to carrier 11 face-down so that the top surface of the semiconductor substrate is pressed against pad 13 by carrier 11. Carrier 11 and table 10 are then rotated, as indicated in FIG. 1, while nozzle 14 delivers slurry to the surface of pad 13. Conditioner 15 rubs back and forth along the surface of the pad. Under these conditions, as semiconductor substrate 12 is rotated against the surface of pad 13, the film residing at the upper surface of semiconductor substrate 12 is polished.

One type of slurry known in the industry is a silicon-dioxide ($SiO_2$) slurry, also known as silica. While silica slurries have been found useful for polishing different types of dielectric films, silica slurries have exhibited significant disadvantages as well. For example, it is well known that polishing processes using silica slurries exhibit low polishing rates resulting in slow throughput times of semiconductor substrates. In addition, pads used in conjunction with silica slurries have a tendency to become "glazed" over time. Glazing occurs when a pad gets worn down and its abrasiveness becomes smoothed.

The degradation in pad roughness over time due to glazing results in low, unstable, and unpredictable polishing rates. This can make the planarization process unmanufacturable since one can only estimate the amount of film removed by the polishing process from one semiconductor substrate to the next. The addition of conditioner 15 to the polishing system of FIG. 1 helps to prevent glazing by roughening pad 13. Unfortunately, while conditioner 15 aids in the prevention of glazing, conditioner 15 increases wear and tear on pad 13, thereby reducing the life of pad 13. Frequent changing of the pads and the use of a conditioner significantly contributes to the manufacturing overhead.

Another type of slurry which has been used as a polishing agent in CMP processes is based on cerium oxide ($CeO_2$), also known as ceria. While ceria slurries provide some advantages over silica slurries, such as high etch rates of many dielectric films, ceria slurries exhibit many disadvantages as well. For example, the polishing etch rate of a film on the surface of a semiconductor substrate using a ceria slurry is highly unstable and unpredictable. Unfortunately, in the case of ceria slurries, the addition of a pad conditioner to the polishing system does nothing to help stabilize the polishing etch rate.

FIG. 2 is a graph showing the polishing etch rate of a film formed on the surface of a semiconductor substrate, a wafer in this case, using a ceria slurry with the polishing apparatus shown in FIG. 1. Note how dramatically the etch rate increases with each successive wafer polished by such a system. The etch rate increases in this manner for each pad used to polish a batch of wafers in the system.

For example, consider the 17th wafer processed having an etch rate of approximately 6500 Å per minute, versus the 33rd wafer processed having an etch rate of approximately 7500 Å per minute as shown in the graph of FIG. 2. Unless some type of robust and reliable end-point detection technique is used, this fluctuation in polishing etch rates of approximately 1000 Å per minute over the course of less than 20 wafers can result in serious manufacturing problems. For example, poorly controlled etch rates can lead to severe over-etching resulting in destruction of underlying IC components, inability to accurately characterize cross-capacitance issues in semiconductor devices, and expensive techniques required to account for film thickness variations at subsequent process steps including contact and via formation.

What is desired is a chemical mechanical polishing technique which provides a high and stable polish rate. In addition, eliminating the pad conditioning step would improve the manufacturability of the overall CMP process.

SUMMARY OF THE INVENTION

A method and apparatus for polishing a film formed over a semiconductor substrate is described. The substrate is pressed up against an abrasive pad so that the film contacts the pad. The pad has a diameter which is less than approximately two times a diameter of the substrate. While pressure is applied to the back of the substrate, the pad is rotated with respect to the wafer and an abrasive ceria slurry is introduced onto the pad to polish the film.

Other features and advantages of the present invention will be apparent from the accompanying drawings and the detailed description that follows.

BRIEF DESCRIPTION OF THE DRAWINGS

The present invention is illustrated by way of example and not limitation in the figures of the accompanying drawings in which like references indicate similar elements and in which.

DETAILED DESCRIPTION

In accordance with the present invention, a small pad is broken-in during a break-in process using a ceria and silica slurry in KOH. The pad is less than approximately two times the diameter of the substrate to be polished. After the pad has been broken-in, consecutive semiconductor substrates comprising silicon wafers having an oxide film formed on the substrate surface are placed face-down on the pad, and are polished using the ceria and silica slurry. The ceria in the slurry serves to increase the polishing rate of the oxide film while the overall method provides a high degree of substrate to substrate polish etch rate uniformity.

In this manner, pad conditioning during the polishing process is obviated. Moreover, in accordance with an embodiment of the present invention, pad conditioning is entirely eliminated throughout the lifetime of the pad. In addition, a method in accordance with the present invention provides such a high degree of wafer to wafer polishing etch rate uniformity that a timed polishing process can be implemented to etch consistent thicknesses of oxide films.

A chemical mechanical polishing process and apparatus for employing that process will be described in more detail below.

Figure 3:
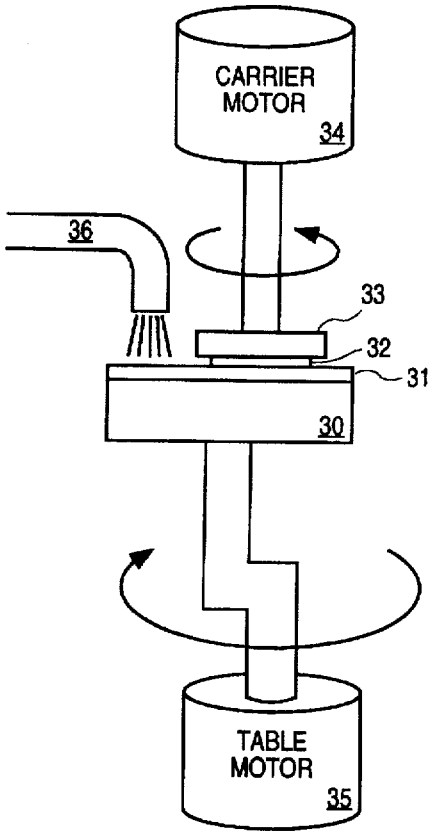
FIG. 3 is a cross-section of a polisher used in accordance with the present invention.

FIG. 3 shows one embodiment of a chemical mechanical polisher used for chemical mechanical polishing or planarization (CMP) of semiconductor substrates in accordance with the present invention. The polisher comprises a semiconductor substrate carrier 33 to which a semiconductor substrate 32 is affixed. Carrier 33 is rotatably coupled to an electric drive motor called a carrier motor 34. A polishing surface comprising a polishing pad 31 is attached to the top of table 30. Table 30 is rotatably coupled to another electric drive motor called a table motor 35. Nozzle 36 is used to transport a slurry or other polishing agents to the surface of pad 31.

In accordance with an embodiment of the present invention, the slurry delivered to the surface of pad 31 through nozzle 36 comprises ceria. The ceria is delivered in a basic chemical solution of KOH. In addition to ceria, silica is also added to this KOH-based slurry. For one embodiment of the present invention, the combination of ceria and silica in the slurry accounts for approximately 10% by weight of the slurry, 2% ceria and 8% silica in KOH. For an alternate embodiment of the present invention, the combination of ceria and silica in the KOH slurry comprises an amount in the range of approximately 2% to 20% by weight of the slurry wherein ceria comprises 20% and silica comprises the other 80% of that amount. For another embodiment, the percentage of ceria is increased while the percentage of silica is decreased, or silica is eliminated, to effectively raise the polishing etch rate of the system. For another embodiment of the present invention, the percentage of ceria is decreased while the percentage of silica is increased to, for example, improve the stability of the process or to decrease the polishing etch rate of the system A slurry comprising both ceria and silica provides as much as a 200% or more increase in the polishing etch rate of a film over a silica slurry alone. The proportionate amounts of ceria and silica in the slurry described above may be appropriately modified by a practitioner with the understanding that an increase in the proportion of ceria will generally increase the polishing rate of a film. Such modification may be carried out to achieve the desired etch rate of a film using a method in accordance with the present invention. In addition, other embodiments of the present invention use an $NH_4OH$ solution in place of the above-described KOH solution as the slurry delivery agent. Also, other basic solutions may be used to transport the ceria and silica to the surface of pad 31 through nozzle 36, such as for example, a combination of KOH and $NH_4OH$.

For other embodiments of the present invention, the slurry may comprise other abrasive particulate matter in addition to the ceria to aid in mechanically etching one or more films from the surface of the semiconductor substrate. Chemical agents may also be added to the slurry to aid in simultaneously chemically etching the film. For an alternate embodiment of the present invention, the basic CMP system shown in FIG. 3 is modified by incorporating the mechanics necessary to deliver the slurry to the surface of the pad in another manner.

Semiconductor substrate 32 is mounted to carrier 33 face-down so that a film formed on the top surface of the semiconductor substrate is pressed against the surface of polishing pad 31 by carrier 33. In accordance with one embodiment of the present invention, semiconductor substrate 32 comprises a silicon wafer upon which semiconductor device components have been formed. Above these components, layers of electrically conductive interconnecting lines are formed to wire the components together, forming an integrated circuit. Each layer of interconnects is electrically isolated by one or more interposing layers of dielectric films. These dielectric films may comprise silicon dioxide ("oxide") materials such as, for example, substantially undoped oxide, borosilicate glass (BSG), phosphosilicate glass (PSG) or borophosphosilicate glass (BPSG). For one embodiment of the present invention, it is these and other oxide-based materials which are polished by methods in accordance with the present invention. Alternatively, other dielectric films are polished by methods in accordance with the present invention. For example, silicon nitride ("nitride"), silicon oxynitride, or even carbon-based organic films are polished from the surface of a substrate.

Alternatively, for some polishing applications such as would be involved in the formation of trench isolation, semiconductor components have not yet been formed on the semiconductor substrate. For these and other embodiments, a CMP process in accordance with the present invention is used to polish films comprising materials from which semiconductor devices may be formed such as, for example, silicon, amorphous silicon, and polysilicon.

For an embodiment of the present invention, the CMP process is used to polish a film down to its underlying etch-stop layer. An etch-stop layer is a layer comprising a material having properties discernibly different from those of the overlying film to be planarized. The purpose of an etch-stop layer is to reproducibly etch away a predetermined thickness of a material during a CMP process such that the thickness of the remaining underlying material is consistent from one semiconductor substrate to the next. For example, for one embodiment of the present invention, the CMP process is used to polish an oxide film down to an underlying nitride layer wherein the nitride layer functions as the etch-stop layer.

While a CMP process in accordance with the present invention is capable of etching a nitride layer, for one embodiment this nitride layer is etched at a slower rate than the rate at which overlying oxide film is etched. Therefore, for an embodiment in which the control of the etch rate of the overlying oxide film is not precise enough for a particular application, the underlying nitride layer serves to slow or stop the polishing process once the desired thickness of oxide has been removed. For other embodiments of the present invention, electronic control circuitry is incorporated into the basic CMP system shown in FIG. 3, whereby the change in friction between an overlying film and an underlying etch-stop layer is sensed and the CMP process is then halted at this interface. These and other endpoint techniques are useful in applications in which the consistency in polishing etch rates from one semiconductor substrate to the next is either imprecise or the deposition technique used to form the films to be polished generates inconsistent film thicknesses from one substrate to the next. However, the requirement that an etch-stop layer be formed to accommodate these endpoint techniques adds to the complexity, cost, and throughput time of the overall manufacturing process.

In accordance with an alternate embodiment of the present invention, the CMP process parameters are tweaked such that the polishing etch rate of a particular film is designed to be relatively constant. For an embodiment of the present invention in which the polishing etch rate of a film is constant enough to reliably etch uniform thicknesses of films across a plurality of semiconductor substrates, and the as-deposited thicknesses of those films are consistent, a timed etch process is implemented. In a timed etch process, the film on the surface of the semiconductor substrate is polished for a predetermined period of time. This predetermined period of time is selected by a practitioner with knowledge of the polishing etch rate of the film given a particular set of CMP process parameters so as to remove a consistent, desired thickness of the film. By using a timed etch process, elaborate endpoint techniques such as, for example, the use of etch-stop layers and measurements of changes in friction between films are obviated. It is to be noted, however, that as compared to the prior art, a timed etch process, while simplifying the overall manufacturing flow, generally requires a vastly improved polish etch rate uniformity from one semiconductor substrate to the next. In accordance with an embodiment of the present invention, significantly improved uniformity is achieved.

A polishing surface is attached to the upper surface of table 30 and comprises a polishing pad 31 capable of transporting materials in the slurry to the interface between semiconductor substrate 32 and pad 31. Pad 31 is slightly roughened to aid in the mechanical polishing of semiconductor substrate 32 and in the transportation of the slurry. Table motor 35 is used to rotate pad 31 along with table 30, thereby distributing the slurry from nozzle 36 in the process.

Carrier motor 34 is used to rotate carrier 33 along with semiconductor substrate 32 against the surface of pad 31. Carrier 33 also serves to forcibly press semiconductor substrate 32 against pad 31 to place the film on the surface of the semiconductor substrate in contact with the pad. For one embodiment of the present invention, carrier 33 presses semiconductor substrate 32 against pad 31 with a pressure in the range of approximately 1 to 15 psi.

To begin the CMP process, for one embodiment of the present invention, carrier motor 34 rotates carrier 33 which in turn rotates semiconductor substrate 32 against pad 31. Concurrently, table motor 35 rotates table 30 which in turn rotates pad 31 against semiconductor substrate 32. While the motors rotate the carrier and table, nozzle 36 distributes the slurry onto the surface of pad 31 and semiconductor substrate 32 is polished. In general, in accordance with the present invention, polishing a film on the surface of a semiconductor substrate begins when the pad is rotated with respect to the semiconductor substrate upon which the film has been formed. This may entail rotating the substrate while the pad remains stable, rotating the pad while the substrate remains stable, or rotating both the pad and substrate simultaneously.

In addition to the features of the CMP system shown in FIG. 3, the polisher incorporates a computerized user interface for control and access of information related to the polishing process. For example, a user can modify the polishing etch rate performed by the system of FIG. 3 by appropriately adjusting the rotational speeds of carrier motor 34 and table motor 35 in addition to adjusting the pressure forcing semiconductor substrate 32 against pad 31 by carrier 33. For one embodiment of the present invention, the carrier motor rotates the carrier and semiconductor substrate at a speed in the range of approximately 5 to 100 R.P.M. Meanwhile, the pad and table are rotated by the table motor at a speed in the range of approximately 20 to 400 rpm.

For other embodiments of the present invention, the pad, substrate, or both are rotated in an orbital motion. Alternatively, additional motors may be incorporated into the basic polishing system of FIG. 3 to add additional axes of rotation between the semiconductor substrate and the polishing pad. For example, and off-axis secondary carrier motor and an axially aligned secondary table motor may be coupled to the shafts extending from the main carrier motor and main table motor, respectively, to provide two additional axes of rotation. Alternatively, the table motor may be removed so that the table remains stationary, while an additional motor is coupled to the carrier motor to rotate the carrier motor and carrier along with the semiconductor substrate around the pad. Also, for another embodiment, the relative speeds of the carrier motor and the table motor are switched so that the carrier motor rotates the carrier along with the semiconductor substrate at a higher velocity than the table motor rotates the table along with the polishing pad.

In accordance with an embodiment of the present invention, the necessity for conditioning polishing pad 31 during the CMP process is eliminated. Because the ceria in the slurry delivered to pad 31 through nozzle 36 becomes embedded into the pad during the CMP process, thereby reducing or eliminating the need for separately conditioning the pad. Embedding of ceria into pad 31 prevents glazing of the pad by the silica in the slurry, serving to maintain the abrasiveness of pad 31. For one embodiment, the pad remains essentially unconditioned throughout the life span of the pad, relying instead on the ceria contained in the slurry to maintain the pad's abrasiveness. For another embodiment, pad conditioning is at least significantly reduced over the prior art CMP process.

Because a pad used in accordance with the present invention is not conditioned, the wear on the pad is greatly reduced, resulting in increased pad life expectancy and the ability to minimize the surface area of the pad. The dimensions of the pad can be minimized because the pad will not become worn out as rapidly as occurs in the prior art, so a smaller surface area can polish a greater amount of film. For one embodiment of the present invention, the diameter of the polishing pad is less than or equal to approximately two times the diameter of the semiconductor substrate being polished, which would be 16 inches in the case of an 8 inch wafer, or 24 inches for a 12 inch wafer. For another embodiment, the diameter of the pad is less than or equal to approximately 1.5 times the diameter of the substrate, which would be 12 inches in the case of an 8 inch wafer, or 18 inches for a 12 inch wafer.

For one embodiment of the present invention, pad 31 is subjected to a break-in process before the film on a first semiconductor substrate in production is polished. As stated above, the ceria in the slurry becomes embedded into the surface of the pad over time. The purpose of the break-in process is to initially "prime" pad 31 by saturating the pad with the ceria slurry, allowing the ceria to impregnate the surface of the pad. This pad break-in process is performed by polishing a dummy substrate with the ceria slurry for approximately 3 to 5 minutes under relatively high-speed rotation and high pressure conditions to accelerate the embedding of the ceria in the slurry into the surface of the pad.

The film on the surface of the dummy substrate preferably comprises the same material as the film to be subsequently polished using the primed pad. For example, for an embodiment in which an oxide film is to be polished, the pad is broken in using a dummy wafer having a surface which is coated with an oxide film. For one embodiment, the CMP process parameters during a pad break-in process which have been found useful are a carrier speed of 15 rpm, a table speed of 300 rpm, and carrier pressure of 7 psi. For other embodiments, the carrier speed is in the range of approximately 25 to 100 rpm; the table speed is in the range of approximately 200 to 400 rpm, and the carrier pressure is in the range of approximately 5 to 15 psi for approximately 2 to 10 minutes.

The small diameter of the pad with respect to the diameter of the dummy substrate used to prime the pad, such as a silicon wafer comprising an oxide film, allows for a quick, consistent, and uniform impregnation of the pad with ceria. During the break-in process, the pad becomes fully saturated with embedded ceria, at which point the polish etch rate substantially stabilizes. As a result, subsequent CMP processing using the broken-in pad is stable and reproducible. Therefore, the time, pressure, and rotational parameters during a break-in process using a dummy substrate, or plurality of substrates, in accordance with the present invention, are adjusted to provide a substantially stable etch rate for subsequently polished semiconductor substrates in production.

A stable etch rate is achieved once the ceria in the slurry has sufficiently and uniformly saturated the polishing pad. In accordance with an embodiment of the present invention, substrate-to-substrate etch rate uniformity of less than 10% is achieved over the course of polishing a sample size of approximately 25 wafers. Etch uniformity is defined as the maximum etch rate minus the minimum etch rate, divided by two times the average etch rate of the substrate sample size. For another embodiment, etch rate uniformity of less than approximately 5% is achieved, and, in particular, an etch rate uniformity of approximately 3% is achieved in accordance with the present invention.

Figure 1:
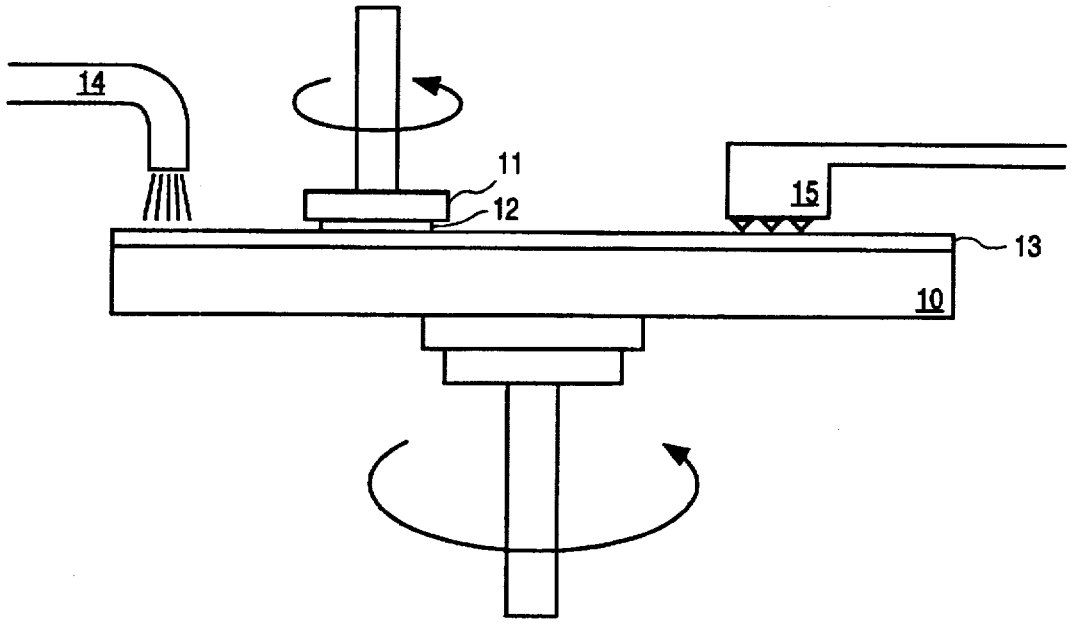
FIG. 1 (PRIOR ART)
FIG. 1 is a cross-section of a polisher.
Figure 2:
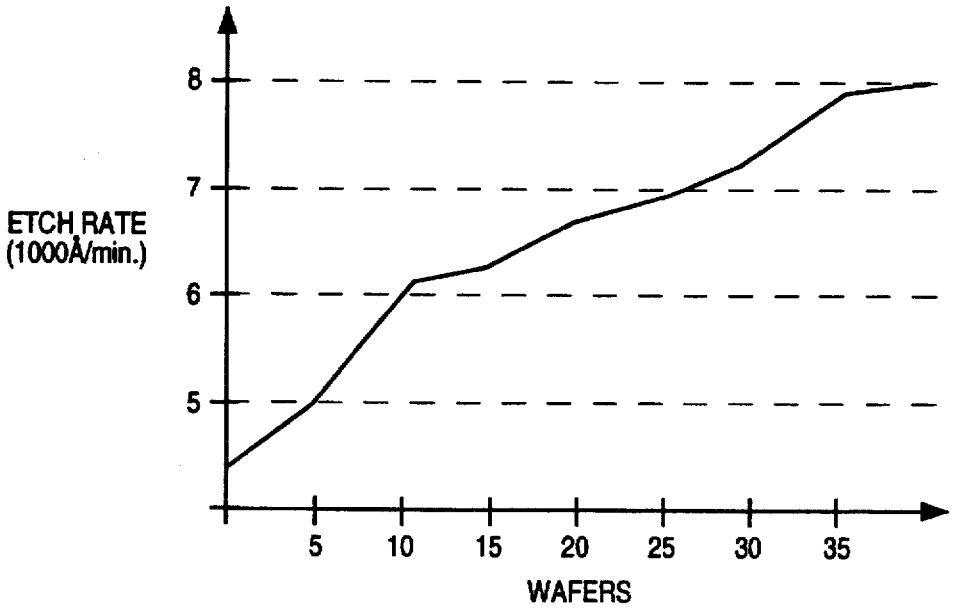
FIG. 2 (PRIOR ART)
FIG. 2 is a graph of etch rate versus wafer for the polisher shown in FIG. 1.
Figure 4:
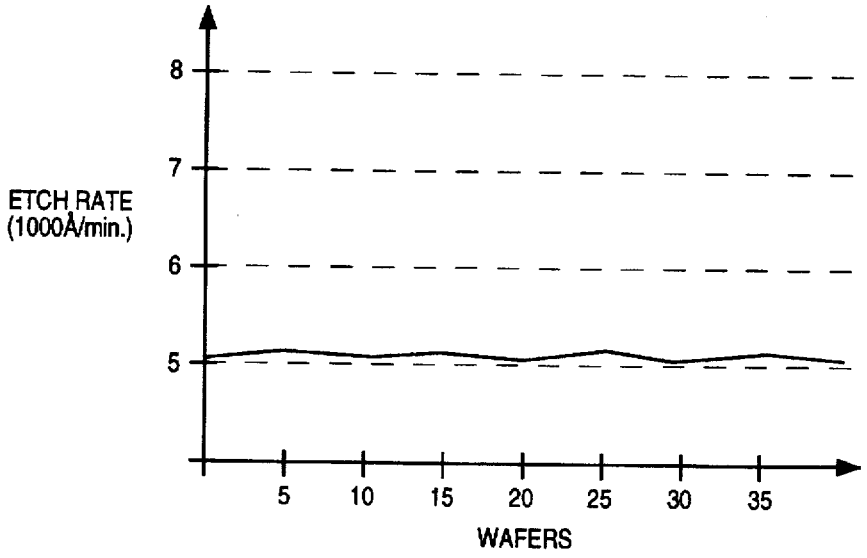
FIG. 4 is a graph of etch rate versus wafer for a polishing process in accordance with the present invention.

The graph of FIG. 4 shows the polishing etch rate of a film versus the semiconductor substrate, wafers in this case, processed in accordance with the present invention. The conditions which produced the graph shown in FIG. 4 were 200 rpm rotational speed of the table and pad, 15 rpm rotational speed of the carrier and wafer, and 7 psi of pressure exerted by the carrier forcing the oxide film on the wafer being polished up against the pad. The slurry used included 2 wt. % ceria and 8 wt. % silica in a KOH solution. These CMP process conditions are found to produce a polish etch rate of approximately 5,000 Å/min. Note the wafer to wafer etch rate stability demonstrated by this CMP process as compared to the unstable and unpredictable polish etch rates of the prior art process shown in FIG. 2. As can be seen by this graph, in accordance with the present invention, a high and stable polish etch rate is achieved. Moreover, the stability of the etch rate is maintained throughout the life of the pad without the need for intermittent or in situ pad conditioning.

For alternate embodiments of the present invention, the speed of the carrier and table motors, pressure exerted by the carrier against the substrate, and the slurry composition are adjusted by the practitioner to produce the desired etch rate for an oxide or other film formed on the substrate. Increasing the speed of either the carrier or table motor, increasing the pressure exerted by the carrier against the substrate, or increasing the abrasiveness of the slurry each have the effect of increasing the etch rate of the film being polished. Likewise, decreasing these parameters have the effect of decreasing the etch rate of the film being polished.

For example, it has been found that for one embodiment, a carrier speed of 15 rpm, table speed of 200 rpm, carrier pressure of 9 psi, and slurry of 2% ceria and 8% silica in KOH produces a polish etch rate of an oxide film of approximately 6,300 Å/min. For another embodiment, it has been found that reducing the carrier pressure to 4 psi while keeping the other parameters constant produces an etch rate of the oxide film of approximately 3,100 Å/min. For yet another embodiment in which the carrier pressure is again raised to 7 psi but the table speed is reduced to 120 rpm, an etch rate of approximately 3,300 Å/min is achieved.

In the foregoing specification, the invention has been described with reference to specific exemplary embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A method of polishing a film formed over a semiconductor substrate comprising the steps of:

a) forcibly pressing the substrate against an abrasive pad such that the film is placed in contact with the pad, the pad having a diameter which is less than approximately two times a diameter of the substrate;

b) introducing an abrasive slurry comprising ceria onto the pad; and c) rotating the pad with respect to the substrate to polish the film at an etch rate.

2. The method of claim 1 further comprising the step of subjecting the pad to a break-in process before polishing a film formed over a semiconductor substrate in production, the break-in process saturating the pad with ceria thereby substantially stabilizing the etch rate.

3. The method of claim 2 further comprising the step of terminating the polishing of the film before the pad reaches an etch-stop layer after a predetermined period of time has elapsed in a timed etch process.

4. The method of claim 2 wherein steps a, b, and c are repeated a plurality of times for a plurality of substrates.

5. The method of claim 4 wherein the etch rate is substantially stabilized by the break-in process to a substrate-to-substrate uniformity of less than approximately 10%.

6. The method of claim 1 wherein the film comprises a material selected from a group consisting of oxide, polysilicon, amorphous silicon, and any combination thereof.

7. The method of claim 1 wherein the diameter of the pad is approximately 1.5 times the diameter of the substrate.

8. The method of claim 5 wherein the diameter of the pad is approximately 1.5 times the diameter of the substrate.

9. The method of claim 1 wherein the slurry further comprises silica and KOH.

10. The method of claim 1 wherein the pad remains essentially unconditioned during the polishing of the film.

11. The method of claim 4 wherein the pad remains essentially unconditioned during and between the polishing of the plurality of substrates.

12. The method of claim 1 wherein the pad is rotated at a speed in the range of approximately 20 to 400 rpm.

13. A method of polishing a film formed over a semiconductor substrate comprising the steps of:

a) breaking in an abrasive polishing pad by polishing a dummy wafer using an abrasive slurry comprising ceria;

b) introducing an abrasive slurry comprising ceria onto the pad;

c) forcibly pressing the substrate against the pad such that the film is placed in contact with the pad, the pad having a diameter which is less than or equal to two times a diameter of the substrate, the film comprising an oxide; and d) rotating the pad with respect to the substrate to polish the film at an etch rate, the pad remaining essentially unconditioned during the polishing of the film.

14. The method of claim 13 wherein steps b, c, and d are repeated a plurality of times for a plurality of substrates.

15. The method of claim 14 wherein breaking in the pad is performed until the etch rate is substantially stabilized to a substrate-to-substrate uniformity of less than approximately 5% before any semiconductor substrates in production are polished.

16. The method of claim 14 wherein breaking in the pad is performed until the etch rate is substantially stabilized to a substrate-to-substrate uniformity of less than approximately 3% before any semiconductor substrates in production are polished.

17. The method of claim 13 further comprising the step of terminating the polishing of the film before the pad reaches an etch-stop layer after a predetermined period of time has elapsed in a timed etch process.

18. The method of claim 13 wherein the diameter of the pad is approximately 1.5 times the diameter of the substrate.

19. The method of claim 13 wherein the diameter of the pad is approximately 1.5 times the diameter of the substrate.

20. The method of claim 13 wherein the slurry further comprises a compound selected from the group consisting of silica, KOH, $NH_4OH$, and any combination thereof.

21. The method of claim 13 wherein the pad remains essentially unconditioned throughout the life span of the pad.

22. The method of claim 15 wherein breaking in the pad comprises rotating the dummy wafer at a speed in the range of approximately 25 to 100 rpm; rotating the pad at a speed in the range of approximately 200 to 400 rpm, and the dummy wafer is pressed against the pad at a pressure in the range of approximately 5 to 15 psi for approximately 2 to 10 minutes.

23. An apparatus for polishing a film formed over a semiconductor substrate comprising:

a carrier to which the substrate is attached, the carrier forcibly pressing the film in contact with an abrasive pad;

a table to which the pad is attached, the pad having a diameter which is less than approximately two times a diameter of the substrate;

a slurry distribution system which saturates the pad with a slurry comprising ceria; and a motor coupled to the table, the motor rotating the table and pad.

24. The apparatus of claim 23 wherein the diameter of the pad is approximately 1.5 times the diameter of the substrate.

25. The apparatus of claim 23 wherein the slurry further comprises a compound selected from the group consisting of silica, KOH, $NH_4OH$, and any combination thereof.

26. The apparatus of claim 23 wherein the motor rotates the table and pad at a speed in the range of approximately 20 to 400 rpm.

* * * * *